US008833762B2

(12) United States Patent
Inose

(10) Patent No.: US 8,833,762 B2
(45) Date of Patent: Sep. 16, 2014

(54) MULTI-FEED DETECTION DEVICE

(71) Applicant: Satoshi Inose, Tsukuba (JP)

(72) Inventor: Satoshi Inose, Tsukuba (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 13/871,474

(22) Filed: Apr. 26, 2013

(65) Prior Publication Data

US 2013/0285319 A1 Oct. 31, 2013

(30) Foreign Application Priority Data

Apr. 27, 2012 (JP) ..... 2012-102425

(51) Int. Cl.
*B65H 7/12* (2006.01)
*B65H 7/02* (2006.01)

(52) U.S. Cl.
USPC ..... 271/262; 271/265.04; 271/263

(58) Field of Classification Search
USPC ..... 271/265.04, 262, 263
See application file for complete search history.

(56) References Cited

U.S. PATENT DOCUMENTS

| | | | | | |
|---|---|---|---|---|---|
| 2,637,552 | A * | 5/1953 | Watson | 271/262 |
| 2,890,884 | A * | 6/1959 | Mestre | 271/262 |
| 6,000,693 | A * | 12/1999 | Tranquilla | 271/263 |
| 6,734,417 | B2 * | 5/2004 | Vejtasa | 250/231.13 |
| 8,091,889 | B2 * | 1/2012 | Muranaka et al. | 271/265.02 |
| 2004/0065996 | A1 * | 4/2004 | Ko et al. | 271/262 |
| 2006/0157921 | A1 * | 7/2006 | Ahn et al. | 271/258.01 |
| 2007/0018383 | A1 * | 1/2007 | Ohara et al. | 271/262 |
| 2011/0210505 | A1 * | 9/2011 | Tomii et al. | 271/265.04 |
| 2011/0210506 | A1 * | 9/2011 | Yamazaki et al. | 271/265.04 |

FOREIGN PATENT DOCUMENTS

| | | |
|---|---|---|
| JP | 3-51248 A | 3/1991 |
| JP | 8-2517227 U | 8/1996 |
| JP | 2517227 U | 8/1996 |

* cited by examiner

*Primary Examiner* — Patrick Cicchino
(74) *Attorney, Agent, or Firm* — Birch, Stewart, Kolasch & Birch, LLP

(57) ABSTRACT

A multi-feed detection device includes: an arm member supported swingably and configured to come into contact with a traveling sheet; and detecting means for detecting whether a plurality of the traveling sheets are overlapped and fed, on the basis of swing of the arm member. The detecting means includes: a detection plate attached to an arm; and a non-contact sensor configured to measure, in a non-contact manner, the positional relation between the non-contact sensor and the detection plate, the positional relation being changed by swing of the arm.

2 Claims, 6 Drawing Sheets

MULTI-FEED DETECTION DEVICE

TECHNICAL FIELD

The present invention relates to a multi-feed detection device configured to detect a plurality of traveling sheets accidentally overlapped.

BACKGROUND ART

In sheet-fed printing presses and the like, for example, sheets are fed one by one from a sheet feed apparatus to a printing unit, subjected to printing, and then discharged to a sheet discharge apparatus. Here, if a plurality of sheets are overlapped and fed from the sheet feed apparatus to the printing unit, printing defects occurs, and wasted sheets are produced accordingly.

In this respect, the feed of sheets is made temporarily stoppable by employing, for example, a sheet feed safety device (see Patent Literature 1 listed below or the like, for example), a detection device (see Patent Literature 2 listed below or the like, for example), or the like. In the sheet feed safety device, a pair of wheels are arranged to sandwich the path line of a traveling sheet, and one of the wheels is supported vertically movably. When a plurality of sheets accidentally overlapped pass between the wheels, the resultant vertical movement of the one wheel swings an arm coupled to the shaft of the wheel. The swing of the arm moves the working end of a potentiometer, thereby detecting that the plurality of sheets are accidentally overlapped and fed. In the detection device, an operating pin and a contact lever are swung to make electric contacts touch each other, so as to detect whether a plurality of sheets are accidentally overlapped and fed.

CITATION LIST

Patent Literatures

{Patent Literature 1}
Japanese Patent Application Publication No. Hei 3-051248
{Patent Literature 2}
Japanese Utility Model Registration No. 2517227

SUMMARY OF INVENTION

Technical Problems

However, in the sheet feed safety device described in Patent Literature 1 listed above or the like, a striker provided to the arm is brought into contact with the working end of the potentiometer to operate the working end; thus, after long-term use, the working end and the striker experience wear deformation and the like, which in turn increases the likelihood of detection errors. For this reason, time and effort are required for periodic maintenance, inspection, and the like.

Moreover, in the detection device described in Patent Literature 2 listed above or the like, a gauge plate of a thickness corresponding to a given sheet thickness is inserted between the arm and the operating pin to adjust the clearance between the electric contacts. Thus, after long-term use, the gauge plate experiences deformation, attachment of dirt, and the like, which in turn increases the likelihood of detection errors. For this reason, time and effort are required for periodic maintenance, inspection, and the like.

In view of the above, an object of the present invention is to provide a multi-feed detection device which is less likely to experience detection errors even after long-term use and which is easily capable of periodic maintenance, inspection, and the like.

Solution to Problems

A multi-feed detection device according to the present invention for solving the aforementioned problems provides a multi-feed detection device including: an arm member supported swingably and configured to come into contact with a traveling sheet; and detecting means for detecting whether a plurality of the traveling sheets are overlapped and fed, on the basis of swing of the arm member, in which the detecting means includes a target, and non-contact measuring means for measuring, in a non-contact manner, a positional relation between the non-contact measuring means and the target, the positional relation being changed by swing of the arm member.

Moreover, a multi-feed detection device according to the present invention provides the above-described multi-feed detection device further including: a bracket member swingably supporting the arm member; a turnable support shaft supporting the bracket member and configured to turn the bracket member; and a holder member rotatably attached to the support shaft and fixedly supported so as not to be turned by turn of the support shaft, in which the target of the detecting means is provided to the arm member, the non-contact measuring means of the detecting means is provided to the holder member, and the support shaft is configured to be turned in such a way as to move the arm member between an operation position at which the arm member comes into contact with the sheet and a retreat position at which the arm member is separated from the sheet.

Furthermore, a multi-feed detection device according to the present invention provides the above-described multi-feed detection device further including: biasing means for biasing the arm member in a direction to contact the sheet, the biasing means being arranged between the arm member and the bracket member; and adjusting means for adjusting contact pressure of the arm member against the sheet.

Advantageous Effects of Invention

In the multi-feed detection device according to the present invention, the non-contact measuring means is used to measure the positional relation between it and the target, which is changed by swing of the arm member, thereby allowing non-contact detection of whether or not a plurality of sheets are accidentally overlapped and fed. Hence, errors are less likely to occur in the detection of the positional relation between the non-contact measuring means and the target by the non-contact measuring means even after long-term use. Accordingly, it is possible to reduce the time and effort required for periodic maintenance, inspection, and the like.

DESCRIPTION OF EMBODIMENTS

An embodiment of a multi-feed detection device according to the present invention will be described with reference to the drawings. Note that the multi-feed detection device according to the present invention is not limited to the following embodiment to be described with reference to the drawings.

<Main Embodiment>

A main embodiment of the multi-feed detection device according to the present invention will be described with reference to FIGS. 1 to 6.

As shown in FIGS. 1 to 4, above the path line of a traveling sheet 1, there is a support shaft supported in such a way as to be capable of being turnably driven. The support shaft 11 has its axial direction set in a horizontal direction (the top-bottom direction in FIG. 1; the direction perpendicular to the surface of Figs. to 4) which is perpendicular to the feed (travel) direction (the right-left direction in FIGS. 1 to 4) of the sheet 1. A keyway 11*a* is formed in the outer peripheral surface of the support shaft 11 in the axial direction of the support shaft 11.

Figure 1:
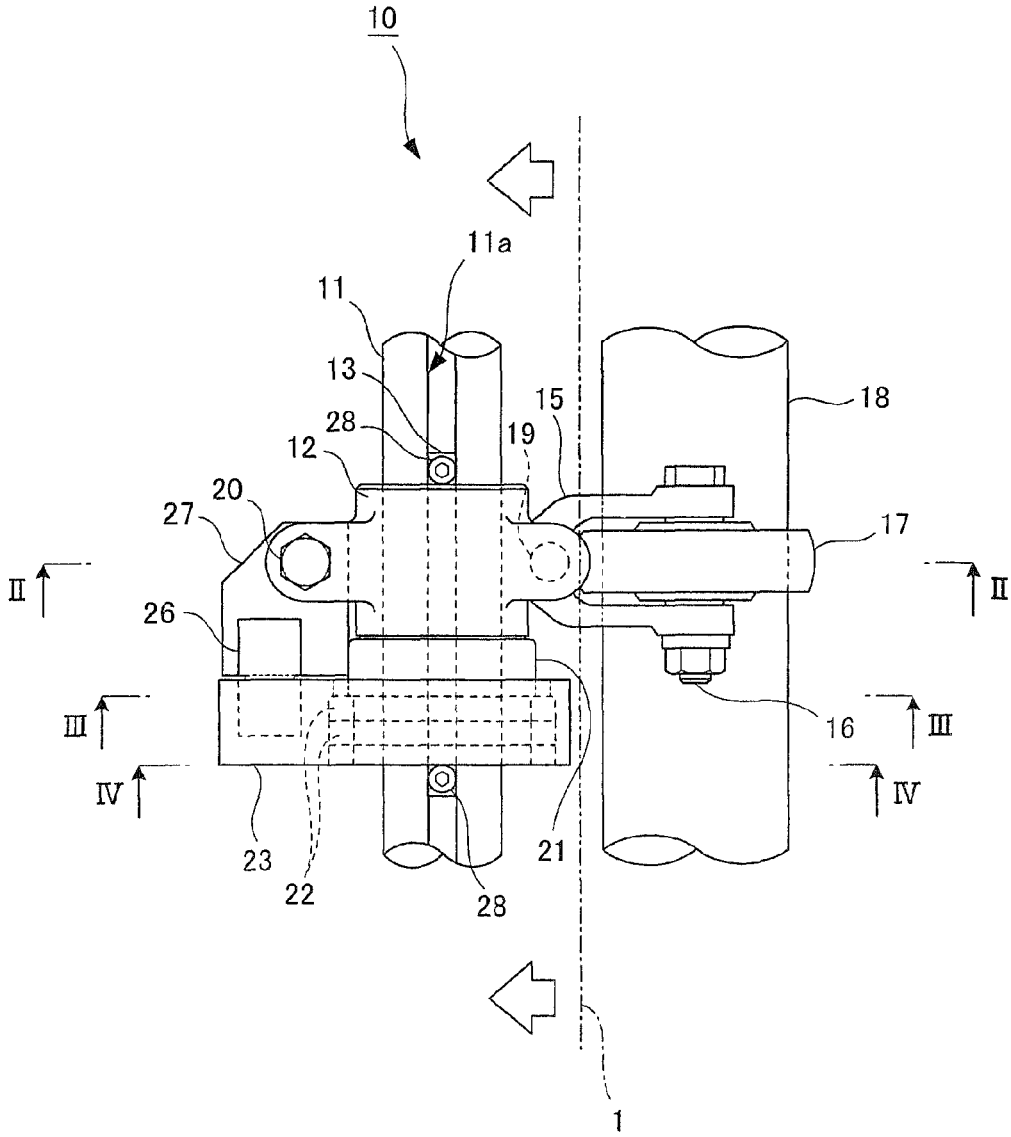
FIG. 1 shows a plan view of a schematic configuration of a chief part of a main embodiment of a multi-feed detection device according to the present invention.
Figure 2:
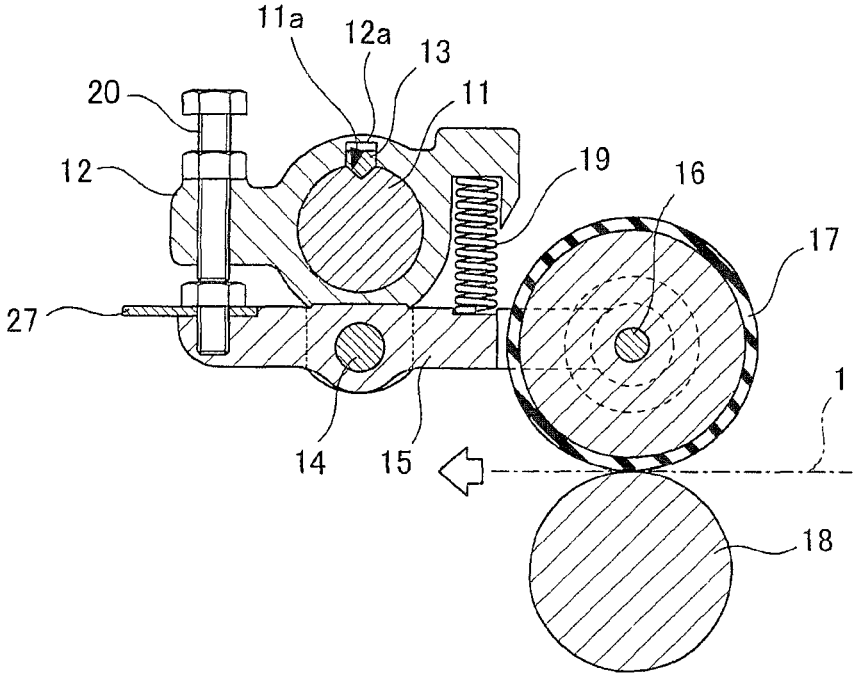
FIG. 2 shows a cross-sectional view taken along a line II-II in FIG. 1 and seen in the direction of arrows II in FIG. 1.

As shown in FIGS. 1 and 2, a bracket 12 is fitted to the outer peripheral surface of the support shaft 11. A keyway 12*a* is formed in the inner peripheral surface of the bracket 12 fitted to the outer peripheral surface of the support shaft 11, in the axial direction of the support shaft 11. A key 13 is fitted in the keyways 11*a* and 12*a* of the support shaft 11 and the bracket 12. Thus, the support shaft 11 can be turned along with the bracket 12 by use of the key 13.

An arm 15 with its longitudinal direction set in the feed (travel) direction of the sheet 1 (the right-left direction in FIGS. 1 and 2) is swingably supported, at its middle portion, on the bracket 12 through a pin 14. A wheel 17 with its axial direction set in the axial direction of the support shaft 11 is rotatably supported on an upstream side of the arm 15 in the feed (travel) direction of the sheet 1 (the right side in FIGS. 1 and 2) through a pin 16. The outer peripheral surface of this wheel 17 is made of rubber.

A roller 18 with its axial direction set in the axial direction of the support shaft 11 is supported in such a way as to be capable of being rotationally driven, at a position below the path line of the sheet 1 under the wheel 17. A compression coil spring 19 being biasing means for biasing the wheel 17 toward the roller 18, i.e. in a direction to bring the wheel 17 into contact with the sheet 1 in the thickness direction thereof, is inserted between the bracket 12 and the arm 15 between the pin 14 and the wheel 17.

An adjustment screw 20 being adjusting means to be screwed in the bracket 12 has a tip side thereof in contact with the upper surface of the arm 15 on a downstream side in the feed direction of the sheet 1 (the left side in FIGS. 1 and 2). By adjusting the screwed position of the adjustment screw 20 in the bracket 12, it is possible to adjust the compressive force of the wheel 17 against the roller 18, i.e. the contact pressure of the wheel 17 in the thickness direction of the sheet 1.

Figure 3:
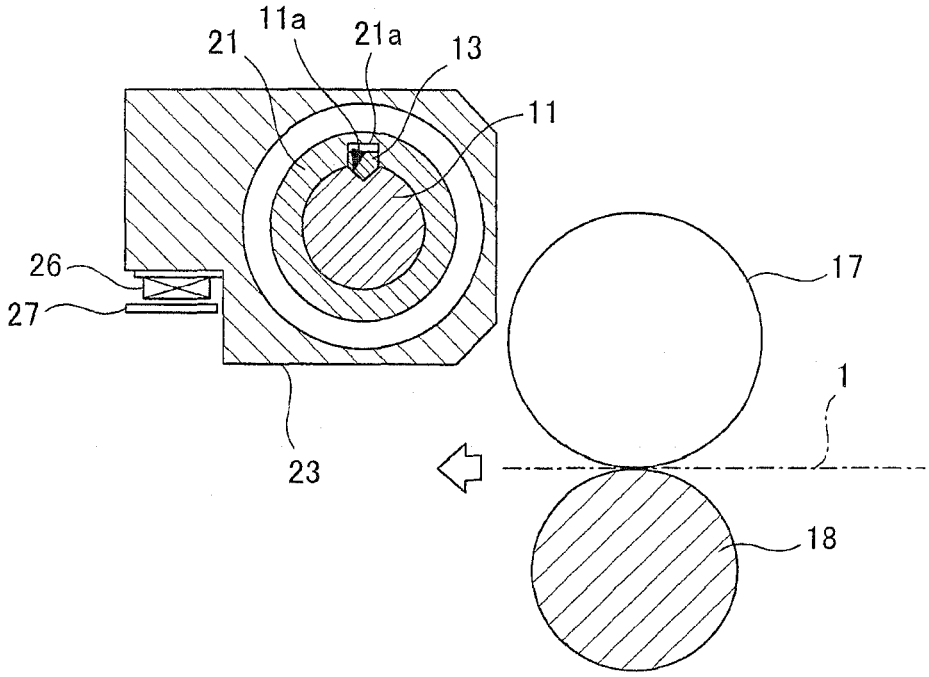
FIG. 3 shows a cross-sectional view taken along a line in FIG. 1 and seen in the direction of arrows III in FIG. 1.
Figure 4:
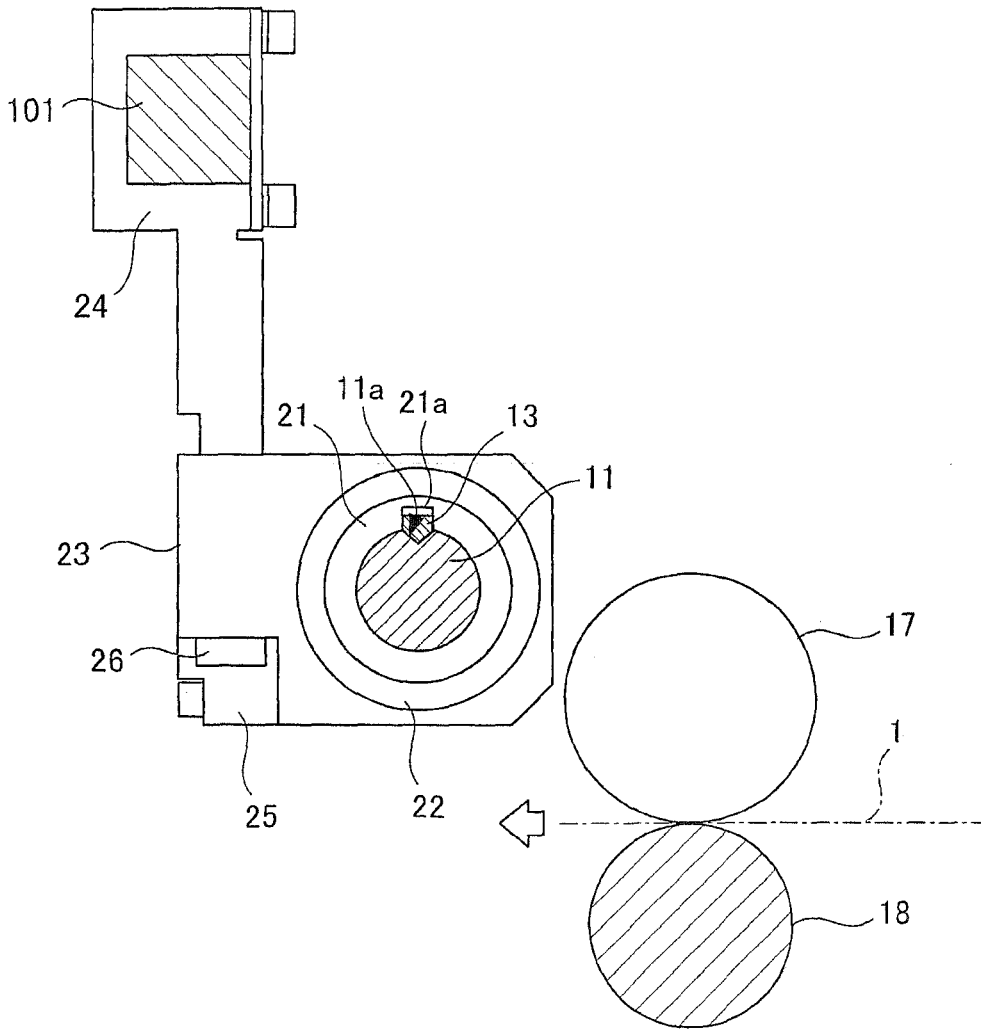
FIG. 4 shows a cross-sectional view taken along a line IV-IV in FIG. 1 and seen in the direction of arrows IV in FIG. 1.

As shown in FIGS. 1, 3, and 4, a sleeve 21 is fitted to the outer peripheral surface of the support shaft 11. A keyway 21*a* configured to be fitted to the aforementioned key 13 is formed in the inner peripheral surface of the sleeve 21 fitted to the outer peripheral surface of the support shaft 11. The inner peripheral surfaces of bearings 22 are coaxially fitted to the outer peripheral surface of the sleeve 21.

A holder 23 fixedly supported on a stay 101, which is fixed to a main frame, through a coupling member 24 is fitted to the outer peripheral surface of each bearing 22. This holder 23 rotatably supports the support shaft 11 through the bearings 22 and the sleeve 21. In other words, the holder 23 is fixedly supported on the stay 101 through the coupling member 24 and also rotatably attached to the support shaft 11 through the bearings 22 and the sleeve 21, so as not to be turned by turn of the support shaft 11.

A non-contact sensor 26 being non-contact measuring means including laser-light emitting part and laser-light receiving part is attached to the lower surface of the holder 23 on a downstream side in the feed (travel) direction of the sheet 1 (the left side in FIGS. 1, 3, and 4) through an attachment member 25 with the light emitting part and the light receiving part facing downward.

As shown in FIG. 2, a detection plate 27 being a target to reflect laser light is attached to the upper surface of the arm 15 on the downstream side in the feed (travel) direction of the sheet 1 (the left side in FIG. 2) while extending to be situated under the non-contact sensor 26 (see FIGS. 1 and 3).

Moreover, the non-contact sensor 26 is electrically connected to an input part and an output part of an unillustrated control device being controlling means. This control device can find the positional relation (distance) between the non-contact sensor 26 and the detection plate 27 on the basis of information from the non-contact sensor 26 obtained by causing the light emitting part of the non-contact sensor 26 to emit laser light, and causing the light receiving part to receive the laser light reflected on the detection plate 27.

Note that reference signs 28 in FIG. 1 denote hollow set screws that fix the key 13 to the support shaft 11.

In this embodiment as above, the bracket 12, the key 13, the hollow set screws 28, etc. form a bracket member; the pin 14, the arm 15, the pin 16, the wheel 17, etc. form an arm member; the key 13, the sleeve 21, the bearings 22, the holder 23, the coupling member 24, and the hollow set screws 28, etc. form a holder member; and the attachment member 25, the non-contact sensor 26, the detection plate 27, etc. form detecting means.

In a multi-feed detection device 10 according to this embodiment configured as above, the screwed position of the adjustment screw 20 in the bracket 12 is firstly adjusted based on conditions such as the thickness of the sheet 1, so as to adjust the compressive force of the wheel 17 against the roller 18, i.e. the contact pressure of the wheel 17 in the thickness direction of the sheet 1 in advance.

Then, stacked sheets 1 are sequentially fed and travel between the wheel 17 and the roller 18. The wheel 17 rises, against the biasing force of the compression coil spring 19, by a distance corresponding to the thickness of the sheet 1 traveling between the wheel 17 and the roller 18. In response to this, the arm 15 swings, and the detection plate 27 thus lowers, hence changing the positional relation (distance) between the non-contact sensor 26 and the detection plate 27.

In this event, the control device finds the positional relation (distance) between the non-contact sensor 26 and the detection plate 27 on the basis of the information from the non-contact sensor 26, which is obtained by causing the light emitting part of the non-contact sensor 26 to emit laser light, and causing the light receiving part of the non-contact sensor 26 to receive the laser light reflected on the detection plate 27.

Based on the positional relation, the control device determines whether or not a plurality of the sheets 1 are accidentally overlapped and fed. If determining that a plurality of the sheets 1 are accidentally overlapped and fed, the control device temporarily stops the feed of the stacked sheets 1.

Figure 5:
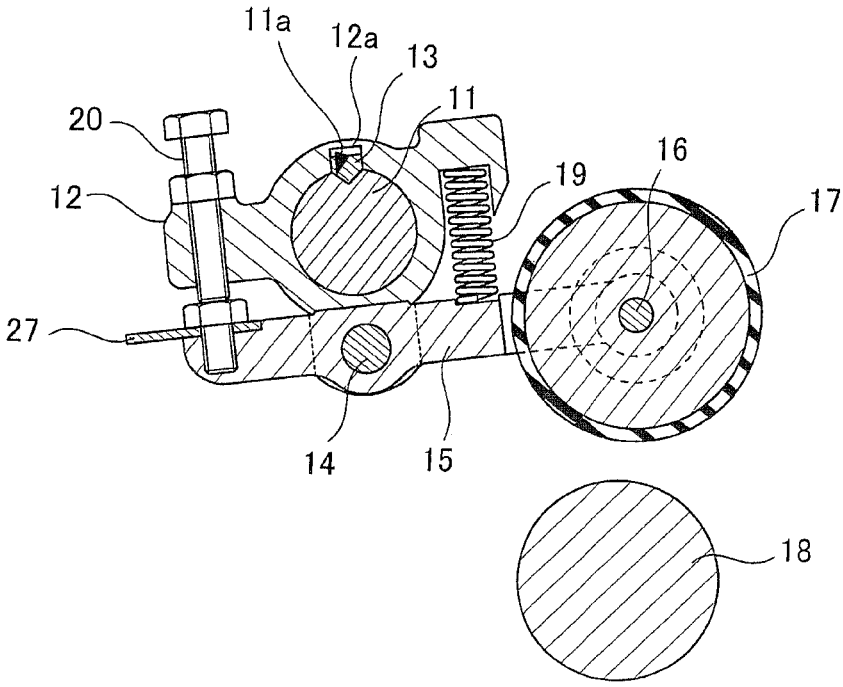
FIG. 5 shows a view of a retreat state corresponding to FIG. 2.
Figure 6:
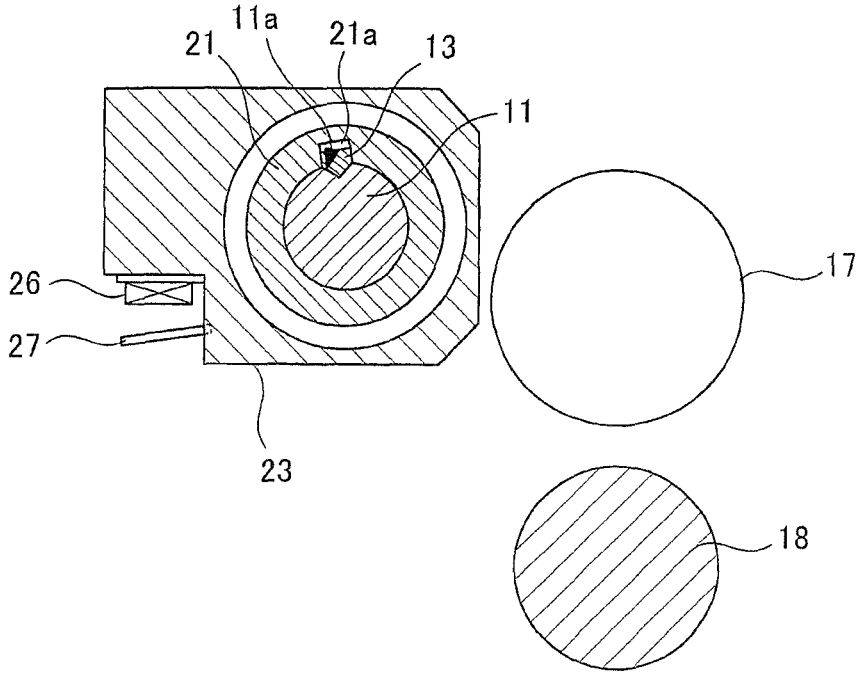
FIG. 6 shows a view of the retreat state corresponding to FIG. 3.

Then, as shown in FIG. 5, the support shaft 11 is turned (counterclockwise in FIG. 5). In this way, the wheel 17 can be separated fro m the roller and moved to a retreat position without causing any contact between the detection plate 27 and the non-contact sensor 26 (see FIG. 6). The sheets 1 in the gap between the wheel 17 and the roller 18 can now be removed from the gap easily.

Once the sheets 1 are removed from the gap, the support shaft 11 is turned (clockwise in FIG. 5) to bring the wheel 17 into contact with the roller 18 and move the wheel 17 to an operation position at which the wheel 17 contacts a sheet 1. One of the sheets 1 removed from the gap is returned to the original position to reuse the sheets 1.

As described above, in the case of a sheet-fed printing press, a plurality of sheets are prevented from being overlapped and fed from a sheet feed apparatus to a printing unit. Thus, it is possible to suppress the occurrence of printing defects and thus significantly reduce wasted sheets.

Specifically, the multi-feed detection device 10 according to this embodiment is configured such that the non-contact sensor 26 is used to find the positional relation (distance) between it and the detection plate 27, thereby allowing non-contact detection of whether or not a plurality of the sheets 1 are accidentally overlapped and fed.

Hence, in the multi-feed detection device 10 according to this embodiment, errors are less likely to occur in the detection of the positional relation between the non-contact sensor 26 and the detection plate 27 by the non-contact sensor 26 even after long-term use. Accordingly, it is possible to reduce the time and effort required for periodic maintenance, inspection, and the like.

<Other Embodiments>

In the foregoing embodiment, the description has been given on the case where the wheel 17 provided rotatably on the upstream side of the arm 15 in the feed (travel) direction of the sheet 1 comes into contact with the sheet 1. Note, however, that it is possible to employ an arm member that allows sliding contact with the traveling sheet 1, for example, as another embodiment.

Moreover, in the foregoing embodiment, the description has been given on the case where the non-contact sensor 26 is attached to the holder 23, and the detection plate 27 is attached to the arm 15. However, it is possible to attach the detection plate 27 to the holder 23 and attach the non-contact sensor 26 to the arm 15, for example, as another embodiment.

Moreover, in the foregoing embodiment, the positional relation (distance) between the non-contact sensor 26 and the detection plate 27 is detected in a non-contact manner by causing the non-contact sensor 26 to emit laser light and causing the non-contact sensor 26 to receive the laser light reflected on the detection plate 27. However, the present invention is not limited to this case. A similar effect to that of the foregoing embodiment can be achieved as long as using non-contact measuring means for measuring, in a non-contact manner, the positional relation between it and a target, the positional relation being changed by swing of the arm member.

Moreover, the multi-feed detection device according to the present invention can be applied, of course, to a case as described in the Background Art where sheets are fed one by one from a sheet feed apparatus of a sheet-fed printing press to a printing unit thereof and subjected to printing. The multi-feed detection device according to the present invention can be applied to any case as long as it involves detection of a plurality of traveling sheets accidentally overlapped.

INDUSTRIAL APPLICABILITY

The multi-feed detection device according to the present invention can reduce the time and effort required for periodic maintenance, inspection, and the like. Accordingly, the multi-feed detection device according to the present invention can be utilized significantly effectively in various industries including printing industries.

{Reference Signs List}

1 SHEET
10 MULTI-FEED DETECTION DEVICE
11 SUPPORT SHAFT
11*a* KEYWAY
12 BRACKET
12*a* KEYWAY
13 KEY
14 PIN
15 ARM
16 PIN
17 WHEEL
18 ROLLER
19 COMPRESSION COIL SPRING
20 ADJUSTMENT SCREW
21 SLEEVE
21*a* KEYWAY
22 BEARING
23 HOLDER
24 COUPLING MEMBER
25 ATTACHMENT MEMBER
26 NON-CONTACT SENSOR
27 DETECTION PLATE
28 HOLLOW SET SCREW
101 STAY

The invention claimed is:

1. A multi-feed detection device comprising:

an arm member supported swingably and configured to come into contact with a traveling sheet; and detecting means for detecting whether a plurality of the traveling sheets are overlapped and fed, on the basis of swing of the arm member;

a bracket member swingably supporting the arm member;

a turnable support shaft supporting the bracket member and configured to turn the bracket member; and a holder member rotatably supporting the support shaft and fixedly supported so as not to be turned by turn of the support shaft, wherein the detecting means includes a target, and non-contact measuring means for measuring, in a non-contact manner, a positional relation between the non-contact measuring means and the target, the positional relation being changed by swing of the arm member, and wherein the target of the detecting means is provided to one of the arm member and the holder member, the non-contact measuring means of the detecting means is provided to the other of the arm member and holder member, and the support shaft is configured to be turned in such a way as to move the arm member between an operation position at which the arm member comes into contact with the sheet and a retreat position at which the arm member is separated from the sheet.

2. The multi-feed detection device according to claim 1, further comprising:

biasing means for biasing the arm member in a direction to contact the sheet, the biasing means being arranged between the arm member and the bracket member; and adjusting means for adjusting contact pressure of the arm member against the sheet.

* * * * *